US006338584B1

(12) United States Patent
Montagutelli

(10) Patent No.: US 6,338,584 B1
(45) Date of Patent: Jan. 15, 2002

(54) COMPACT PRINTING MECHANISM

(75) Inventor: Denis Montagutelli, Paris (FR)

(73) Assignee: A.P.S. Engineering S.A.R.L., Paris (FR)

( * ) Notice: Subject to any disclaimer, the term of this patent is extended or adjusted under 35 U.S.C. 154(b) by 0 days.

(21) Appl. No.: 09/380,878

(22) PCT Filed: Mar. 11, 1998

(86) PCT No.: PCT/FR98/00487

§ 371 Date: Sep. 10, 1999

§ 102(e) Date: Sep. 10, 1999

(87) PCT Pub. No.: WO98/40221

PCT Pub. Date: Sep. 17, 1998

(30) Foreign Application Priority Data

Mar. 11, 1997 (FR) ..... 97 02861

(51) Int. Cl.[7] ..... B41J 2/315
(52) U.S. Cl. ..... 400/120.01; 400/693
(58) Field of Search ..... 400/120.01, 124.02, 400/58, 124.12, 120.05, 691, 693, 694

(56) References Cited

U.S. PATENT DOCUMENTS 3,855,448 A * 12/1974 Hanagata et al. ..... 219/216
4,475,825 A * 10/1984 Hashimoto ..... 400/120
5,118,208 A * 6/1992 Kitahara et al. ..... 400/56
5,435,541 A * 7/1995 Fornay et al. ..... 271/189
5,993,091 A * 11/1999 Ishida et al. ..... 400/234
6,099,175 A * 8/2000 Maurer et al. ..... 400/24
6,102,509 A * 8/2000 Olson ..... 347/8

* cited by examiner

*Primary Examiner*—John S. Hilten
*Assistant Examiner*—Darius N. Cone
(74) *Attorney, Agent, or Firm*—Armstrong, Westerman, Hattori, McLeland & Naughton, LLP

(57) ABSTRACT

The invention concerns a printing mechanism designed for producing an ultra-compact mechanism. The thermal printing mechanism comprises a frame, a motor and a gear assembly driving a roller (7), a thermal printing head (8), a member pressing (9) the head (8) on the roller (7), characterized in that it comprises a member providing at least vertical rigidity (1) to two separate sides of the frame and at least rotational resistance along an axis substantially perpendicular to a third side of the frame, or, at least rotational resistance to two sides of the frame. The invention is useful for printing mechanisms of electronic payment terminals.

12 Claims, 3 Drawing Sheets

18
16
2
17
7

COMPACT PRINTING MECHANISM

FIELD OF THE INVENTION

This invention concerns a printing mechanism, designed for producing an ultra-compact mechanism.

BACKGROUND OF THE INVENTION 20 mm thick compact mechanisms are available on the market. These mechanisms are realised by means of a frame in plastic material which holds all the constitutive elements of the mechanism, in particular, the motor and organs of associated transmission (pinions), the printing head and its eventual support (that can be part of said head) the paper driving roll, the pressure organ of the printing head on the roll between which the paper is released.

There are also mechanisms realised of metallic elements which are generally fixed to each other with the help of screw and screw cuttings in the sheet metal, but in this case, the complexity of the mechanism makes its encumbrance important, reduces its reliability and makes the cost exorbitant. Furthermore, the impossibility to realise complex forms in this type of material (projections, multiple holes, . . . ) makes it difficult to obtain restricted tolerances.

The most important prior art in the case of a compact mechanism is a plastic base on which the constitutive elements of the mechanism are fixed.

In the European Patent Application No.0718110, a mechanism for the assembly of a thermal printing head comprising a frame and a roll, which is mounted in rotation between the two lateral walls of the frame, and a printing head which is mounted facing the frame between the side walls, is disclosed. Furthermore, this mechanism includes a pressure element assembled in rotation with the frame and adapted to bring the printing head in contact with pressure on the roll and a pressure level assembled in rotation with the frame. The pressure element is supported by the lever in such a way as to press the printing head with the roll.

In the European Patent Application No.0738606, a mechanism to uniformize a printing head squeezed against a roll is disclosed. The mechanism includes a frame, a printing head, a roll and a spring, which squeezes the printing head against a roll.

In the European Patent Application No.0659574, a printing mechanism, which includes a printing head and a roll on which the printing head is compressed, is disclosed. The mechanism is such that the number of its pieces is reduced. This mechanism includes a lever, which allows to put in contact or not the printing head and the roll.

The mechanisms described in these documents concern essentially means for allowing the roll and the printing head to be put in contact by pressure.

However, one wishes to reduce the volume of the known mechanisms. These mechanisms are such that the frame is mostly in plastic material.

The main drawback of plastics, when one wishes to further reduce the volume of the mechanism, is its rigidity. In fact, the critical point of a thermal printing mechanism is to realise a good alignment between the generatrix of the roll and the line of points of the printing head. However, when the thickness of the mechanism is reduced, it is necessary to reduce the diameter of the roll, so that a contact surface (or "plate" of the roll) becomes smaller and smaller.

One of the most delicate problems to solve in the case of compact mechanisms is that of the alignment of the roll, which guides the paper, with the printing head. In fact, the more compact the mechanism, the smaller the diameter of the roll. Thus, the contact surface between the roll and the printing head becomes smaller and smaller, and the alignment becomes more and more delicate to realise. Furthermore, in such case, the only solution for producing compact and small mechanical pieces, namely small axes and holes, it is to realise the printing frame in a single piece in plastic material which carries all the elements maintaining the mechanical pieces (gears, printing head, roll, motors, and sensors). The problem is that the mechanical stability of this frame is no longer sufficient when the frame is subject to mechanical constraints such as the application of pressure on the printing head, even when this pressure is applied in symmetrical way on the frame.

Furthermore, when the printing width increases, the effects of the small thickness and the alignment problems are strongly increased.

Even worse, when the raising is carried out on a single side, as occurs on this mechanism, and in all mechanisms with these constraints (considering the difficulty of producing a clamping device on both sides of the frame without exiting the imposed volume), the frame twists and it is almost impossible to disengage the head of the roll on the side opposite the raising lever.

The weight on the printing head can be increased or the hardness of the roll reduced in order to remedy the aligning problem. These two factors play in favor of widening the contact tolerance of the roll and of the printing head, but is detrimental, in the case of weight increase, to the limitation of the inner efforts of the frame (rigidity of the frame in plastic material), and in the case of reduction of the roll hardness, to the friction of the roll on the head in the absence of paper.

This situation is to consider when one wishes to charge the paper without proceeding to a raising of the printing head, which is often the case so to optimise the ergonomy of use of mechanism.

Another way to manage the problem consists in providing a rib or ribs on the frame in plastic material, which stiffens it, but which is disadvantageous in that it uses a precious volume when compactness is wanted and it prevents an easy assembly of the different elements because, most of the time, a central rib obstructs the inside of the mechanism. In particular, the pressure and support points of the pressure organs have to be symmetrically placed on the head, which results in a great difficulty of construction while maintaining an easy assembly process.

The invention proposes to solve the problem of the roll generatrix alignment with the dotted line of the printing head by stiffening the printing structure by means of a specific device.

The problem posed by the alignment of the roll with the head can be summarized by the fact that the plastic frame itself twists when a constraint is applied to it. In fact, it is this type of deformation that provokes a lifting of one of the two sides of the head with respect to the roll. This type of problem appears in at least the three following cases:

- Constraint applied to the base of the frame when the frame is fixed on non-flat support (hyper-static nature)
- Non-symmetrical support or application of the pressing device relative to the frame
- Raising of the head, when the pressing device applies on a single side of the head.

If one can accept the first two points, it is practically impossible to do with the last point. In fact, for producing a very flat mechanism, it is necessary to carry out the raising function on a single side of the mechanism so that the mechanical elements do not pass through the mechanism, which would compromise its thickness.

But in this way all the pressure from the pressing device is applied to a single side of the mechanism, thus creating a strong twisting constraint on the frame.

Most mechanism on the market are made with elements passing through the head or acting symmetrically on the head or on the pressing device so as to eliminate this unilateral constraint.

SUMMARY OF THE INVENTION

To this effect, this invention concerns a thermal printing mechanism comprising a frame, a motor and gears driving a roll, a thermal printing head, and a pressing device for pressing the head on the roll, characterized in that it includes a stiffening device which is at least integral vertically respective to two distinctive sides of the frame, and at least integral in rotation according to an axis essentially perpendicular to the third side of the frame, or which is at least in rotation respective to two sides of the frame.

Thus, according to the invention, a plate of sufficient thickness (here, 1.5 mm) is installed so as to prevent the frame from twisting. The plate constitutes the final phase of the assembly (before the printing test), and is fixed only by a single self-threading screw, because an inner encasing system, without adding a slide in the mold, allows to block all vertical motion of the sides of the frame relative to the base. The rigidity thus obtained is such that there is no deformation of the frame when the head is raised.

According to an embodiment of the invention, the mechanism is such that the stiffening device is a plate which is inserted between two horizontally shifted contacts on each of the sides of the frame, and said plate is maintained integral in rotation according to an axis essentially perpendicular to a base of the frame by means of an attaching device which is a single screw.

The mechanism according to the invention is such that the fixing device passes through the mechanism, and ensures a locking in rotation relative to the two faces carrying the printing roll.

The mechanism is such that the stiffening device includes points of attachment of the printing mechanism.

The mechanism can also include a lever acting on a single side of the printing head, realising the triple function user control, control of the position sensor, and direct control of the raising of the head.

In the case of a large printing width (80 mm to 110 mm), this system signifies the whole frame, which makes alignment very easy. Further mechanical elements can then be fixed to the frame without risk (paper winder, paper roll support, etc.).

Finally, the stiffening device can be constituted of a printed circuit, which stiffens the frame while performing an electronic function as the driving of the printer.

According to the invention, the stiffening device allows to maintain the two sides of the mechanism always aligned one with the other, and thus, eliminates any potential twisting.

A first possible embodiment is the use of a stiffening plate, integral with each of the two lateral sides, so that in the case of misalignment of the two sides, a rotation of the plate is caused. It is therefore no longer perpendicular with the sides, and in particular with the base. It presents an angle in the horizontal plane with the base. The principle is then to maintain it firmly (according to three support points) in a flat position relative to a plane perpendicular to the base of the mechanism, which immobilizes all potential rotation of the plate.

Assembly of the plate according to the invention represents the final phase of the assembly of the mechanism. It needs only one single self-threading screw facilitating its attachment. This screw is the only screw of the mechanism. The plate is inserted between contacts placed inside the frame and shifted, which allows an easy unmolding of the piece, an easy insertion of said plate, and a single attachment screw.

The plate is large and extends amply on the mechanism sides, which creates an important lever arm and consequently a higher resistance to twisting. As the plate is mounted during the final assembly phase, it does not hamper previous phases, in particular the assembly of the motor (lateral and inner), and the assembly of the printing head (inner insertion and rotation).

It is possible to use a device ensuring a non-rotation relative to each other of the two sides of the frame carrying the roll or the printing head. This can be carried out for example with a "T" profile traversing the frame and locking on the other side.

Thus, it is possible to use an extremely simple lever.

The head-raising lever operates in a direction opposite that of usual levers: the separation of the head of the roll is realised by pushing the lever downwards and not upwards. This is the reason why the lever is in bascule shape, which allows, without exiting from the volume in lowered head position, to lift the head in this direction. Without this, the gripping of said lever would be strongly complicated.

Furthermore, this lever applies directly against the head support constituted by a metallic plate, so that the configuration could not be simpler, and also applies the pressure on the high position detection switch.

The invention concerns furthermore a pinion allowing to lock the roll in its housing and to lock the pinion on the roll, and performing a bearing function between the roll and the frame of the printer.

The fact that the roll realises the bearing function allows to increase its length, which allows to house a clipping device without increasing the volume. This innovation allows to reduce the number of pieces which perform these functions from three to one: a distinct bearing for the gear, a gear and a latching clip are generally necessary. Furthermore, the assembly is done by simple manual insertion of the gear in the roll after placement of the latter in its housing. The clipping sound confirms a good insertion.

The description, with reference to drawings, supplied as example, will allow to understand how the invention can be put into practice.

DETAILED DESCRIPTION OF A PREFERRED EMBODIMENT

Figure 1:
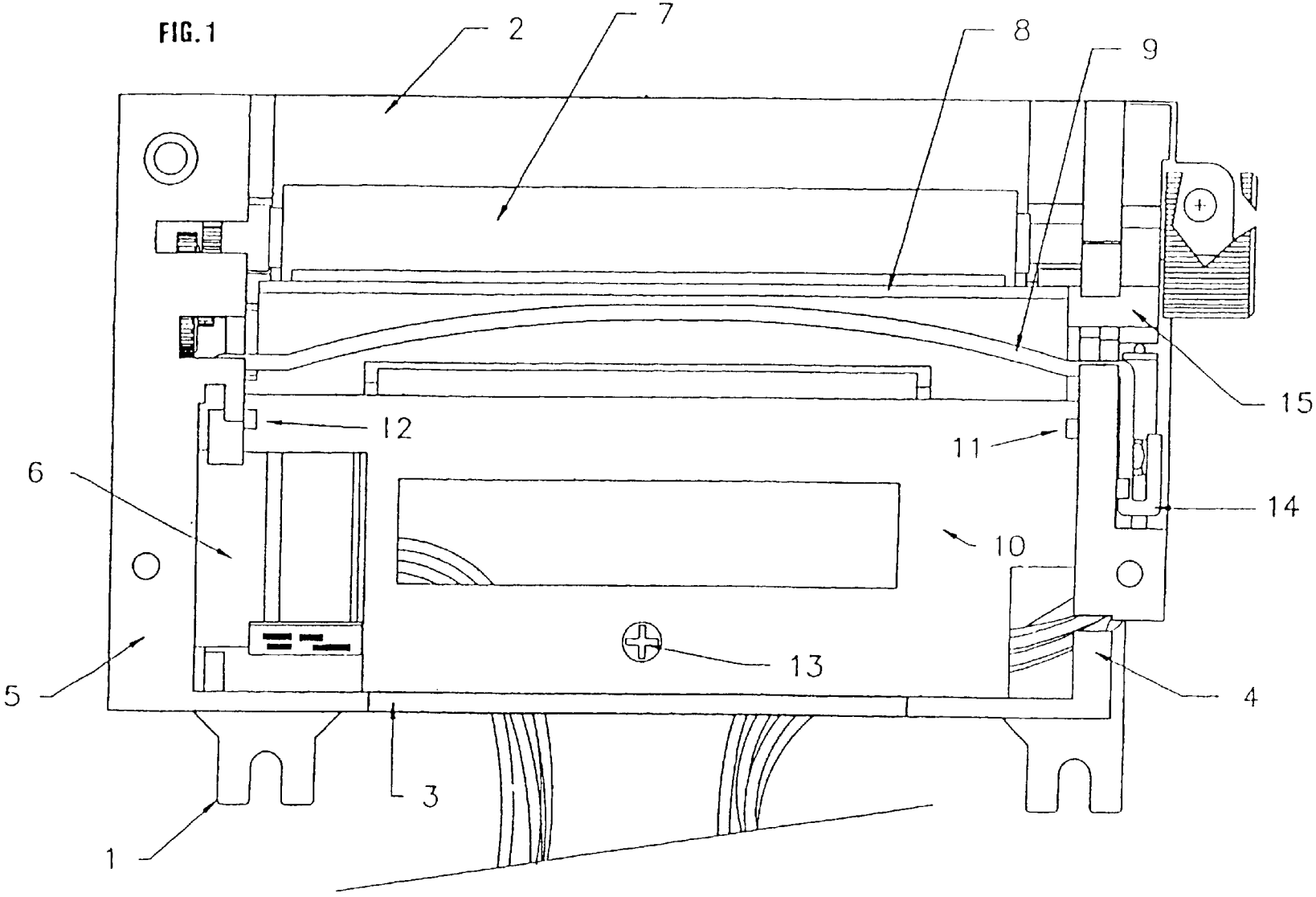
FIG. 1 is an aerial view of the mechanism according to this invention.
Figure 2:
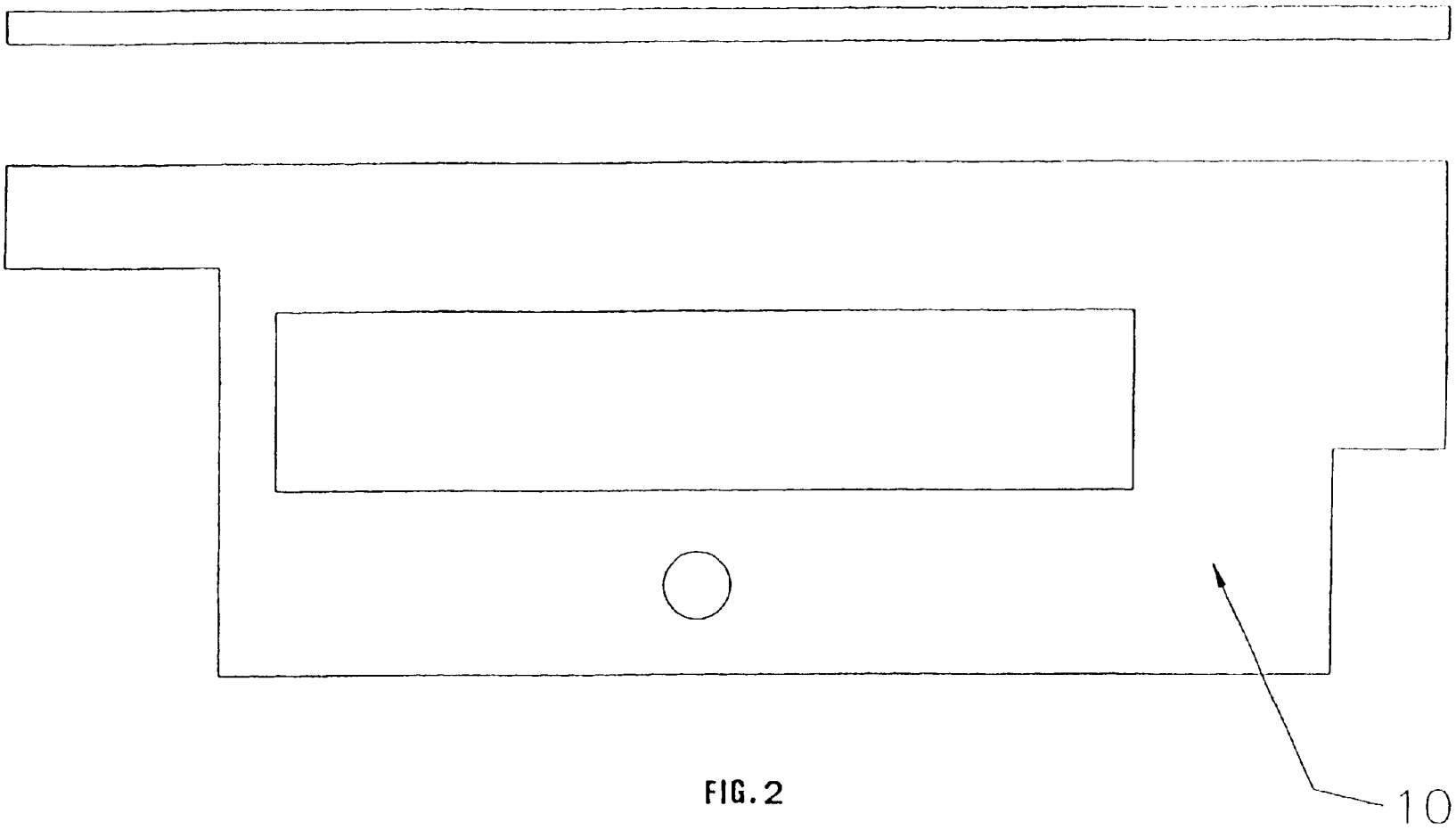
FIG. 2 is a view of a stiffening plate according to the invention.

In FIG. 1, a mechanism according to the invention is represented.

The mechanism according to the invention includes a printing frame 1 which includes two longitudinal sides 2, 3 and two transverse sides 4, 5, a motor 6 and gears driving a roll 7. The mechanism includes, in a known way, a printing head 8, for example a thermal one. The mechanism includes a pressing device 9 on the roll 7. The printing head 8 is maintained in pressure against the roll 7 by means of a spring 9.

According to the invention, the mechanism includes a stiffening device 10. Preferably, this stiffening device 10 is a plate, for example in metal or in hard synthetic material. This plate 10 is such that it is at least integral vertically respective to two distinct sides of the frame, and at least integral in rotation according to an axis essentially perpendicular to a third side of the frame, or at least integral in rotation respective to the two sides of the frame.

The stiffening device 10 is fixed by means of a screw 13. This screw 13 passes through the mechanism and ensures a locking in rotation relative to the two faces carrying the printing roll 7.

In FIG. 1, the lever 14 which acts on the printing head 8 can be seen. This lever is integral to an end of the roll 7. This lever 14 operates in the following way: the separation of the head 8 of the roll 7 is done by pushing the lever downwards. The lever also applies pressure on the switch 15.

Figure 3:
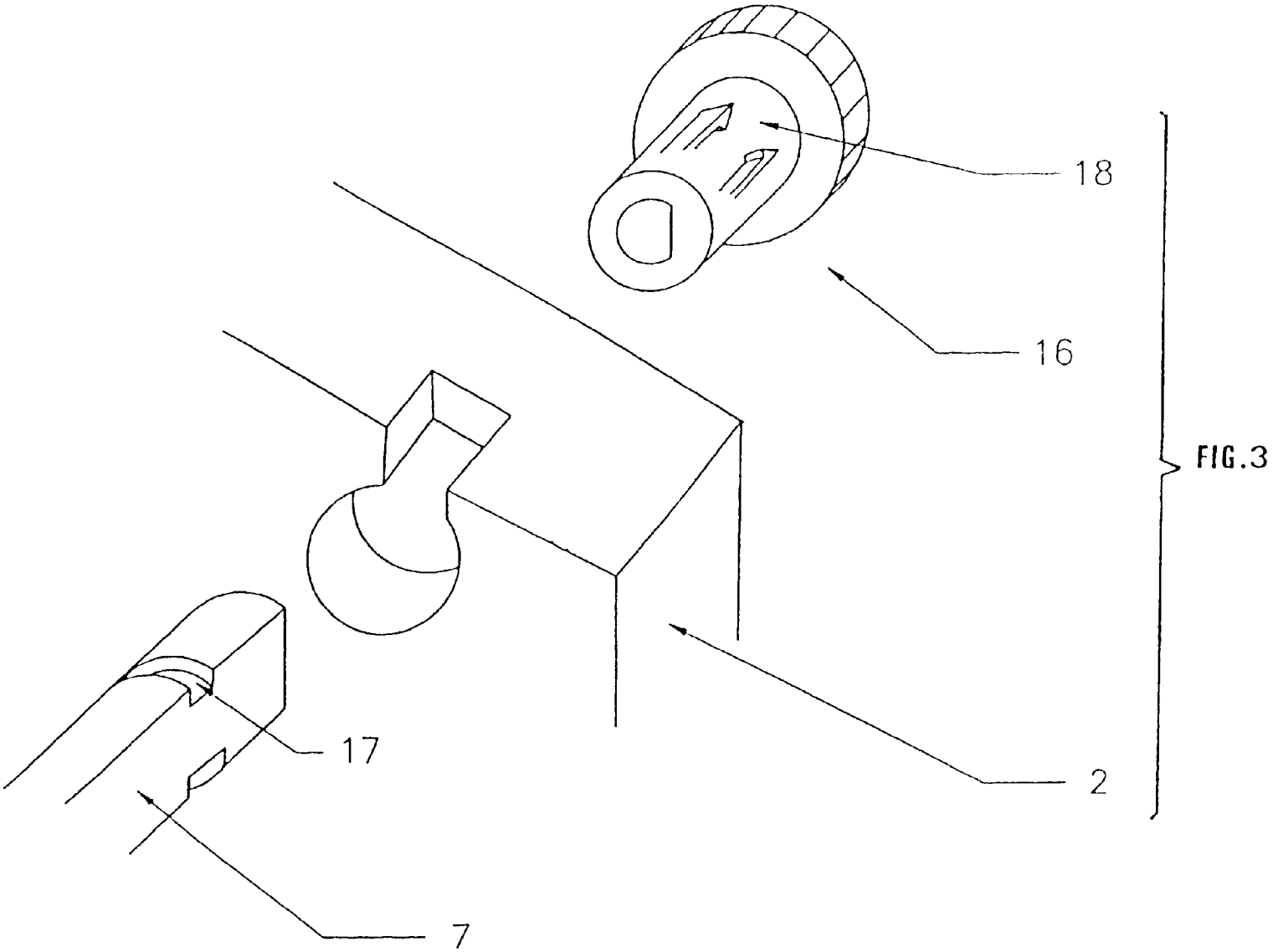
FIG. 3 is an exploded view of the pinion according to the invention.

In FIG. 3, the pinion 16 which allows to lock the roll 7, which passes in a hole managed in the transverse side 5 of the frame, is represented. The axis of the roll includes a groove 17 for the clamping of the roll. Furthermore, the roll includes a stage 18 between the roll and the transverse side 5 of the frame.

The mechanism according to the invention has many advantages. It can maintain its compactness when one wishes to increase the printing width. It allows to produce very flat mechanisms by the use of a small roll diameter. It allows to keep assembly simple despite its compactness, and it allows to obtain a large width printing mechanism while maintaining the same thickness.

What is claimed is:

1. Thermal printing mechanism comprising:

a frame having four sides including a pair of opposed longitudinal sides and a pair of opposed lateral sides, said frame defining a horizontal main plane of the frame and each of said sides defining a horizontal main axis of the side, a roll having a main rotation axis located in said plane, a motor and gears driving said roll, a thermal printing head, and a pressing device pressing the head on the roll, wherein a stiffening device formed as a plate is mounted to two opposite sides selected from said pair of opposed longitudinal sides and said pair of opposed lateral sides of the frame, said stiffening device being located in a plane parallel to said main plane, and a connecting structure between said stiffening device and said frame being such that said stiffening device is at least (i) (a) blocked vertically respective to each of the two opposite sides of the frame, and (b) blocked in rotation according to an axis essentially parallel to the main plane of the frame and essentially perpendicular to the main axis of a third side among said sides of the frame other than the two opposite sides to which the stiffening device is mounted, or (ii) blocked in rotation according to each of respective axes essentially parallel to said main frame and essentially perpendicular to the respective main axis of each of the two opposite sides of the frame.

2. Mechanism according to claim 1, wherein the plate fits between two contacts of each of the opposite sides of the frame and is blocked in rotation according to an axis essentially perpendicular to a base of the frame by means of a single screw.

3. Mechanism according to claim 2, wherein the plate passes through the two opposite sides to thereby ensure the blocking in rotation relative to the two opposite sides.

4. Mechanism according to claim 1, wherein the stiffening device includes attachment points of the printing mechanism.

5. Mechanism according to claim 1, which includes a lever applied directly to a support of the printing head.

6. Mechanism according to claim 2, wherein the stiffening device includes attachment points of the printing mechanism.

7. Mechanism according to claim 3, wherein the stiffening device includes attachment points of the printing mechanism.

8. Mechanism according to claim 2, which includes a lever applied directly to a support of the printing head.

9. Mechanism according to claim 3, which includes a lever applied directly to a support of the printing head.

10. Mechanism according to claim 4, which includes a lever applied directly to a support of the printing head.

11. Mechanism according to claim 1, wherein the plate is a printed circuit of a sufficient thickness to stiffen the frame and fulfill an electronic function including driving of printing.

12. Thermal printing mechanism comprising a frame having two longitudinal sides and two lateral sides, a motor and gears driving a roll, a thermal printing head, a pressing device of the head on the roll, which includes a stiffening device which is mounted to two opposite sides of the frame and at least (i) (a) blocked vertically respective to each of the two opposite sides of the frame, and (b) blocked in rotation according to an axis essentially perpendicular to a third side of the frame, or (ii) blocked in rotation respective to each of the two opposite sides of the frame, the stiffening device being constituted by a plate which is a printed circuit of a sufficient thickness to stiffen the frame and fulfill an electronic function including driving of printing.

* * * * *